US007520397B1

(12) United States Patent
Segale

(10) Patent No.: US 7,520,397 B1
(45) Date of Patent: Apr. 21, 2009

(54) MULTIFUNCTIONAL CUP HOLDING RACK

(76) Inventor: Joyce M. Segale, 77 Cheney Hill La., Rutland, VT (US) 05701

( * ) Notice: Subject to any disclaimer, the term of this patent is extended or adjusted under 35 U.S.C. 154(b) by 0 days.

(21) Appl. No.: 12/002,277

(22) Filed: Dec. 17, 2007

(51) Int. Cl.
*A47F 5/08* (2006.01)

(52) U.S. Cl. ..... 211/106; 211/75; 211/85.31; 211/DIG. 1

(58) Field of Classification Search ..... 211/126.7, 211/133.2, 106, 181.1, 74, 75, DIG. 1, 133.5, 211/85.18, 85.31, 85.26, 41.4, 87.01, 126.9; 220/483; 206/818; D6/566, 458, 462; 248/311.2, 248/309.1, 175, 153, 302, 465.1, 683, 206.5, 248/309.4, 350
See application file for complete search history.

(56) References Cited

U.S. PATENT DOCUMENTS

| | | | | | |
|---|---|---|---|---|---|
| 328,926 | A | * | 10/1885 | Elliott | 211/75 |
| 783,505 | A | * | 2/1905 | Burt | 211/85.26 |
| 843,826 | A | * | 2/1907 | Kloeppinger | 211/75 |
| 1,077,027 | A | | 10/1913 | Austin | |
| 2,123,837 | A | * | 7/1938 | Thomas et al. | 211/85.31 |
| 2,456,535 | A | * | 12/1948 | Rundell | 248/302 |
| 2,469,966 | A | * | 5/1949 | Idle | 211/85.31 |
| 2,510,453 | A | * | 6/1950 | Yoars | 211/126.15 |
| 2,529,287 | A | * | 11/1950 | Garwood | 211/75 |
| 2,868,385 | A | * | 1/1959 | Dreyfus, Jr. | 211/85.31 |
| 2,951,590 | A | * | 9/1960 | Feser | 211/75 |
| 3,532,225 | A | * | 10/1970 | Reed | 211/181.1 |
| 3,858,835 | A | * | 1/1975 | Baren | 248/94 |
| 3,955,682 | A | | 5/1976 | Baren | |
| 4,248,397 | A | | 2/1981 | Casper | |
| 4,679,695 | A | | 7/1987 | Leff | |
| D314,487 | S | | 2/1991 | Bajek et al. | |
| 5,114,106 | A | | 5/1992 | Daugherty et al. | |
| D389,688 | S | | 1/1998 | Iacono | |
| D390,056 | S | | 2/1998 | Pujals, Jr. | |
| D396,372 | S | | 7/1998 | Goodman | |
| D401,461 | S | | 11/1998 | Laga | |
| 6,032,808 | A | * | 3/2000 | Henson | 211/85.23 |
| D430,441 | S | | 9/2000 | Rosenberg | |
| D436,486 | S | | 1/2001 | Janis | |
| 6,398,045 | B1 | * | 6/2002 | Chao | 211/181.1 |
| 6,502,705 | B1 | * | 1/2003 | Ziegler | 211/74 |
| 6,997,329 | B2 | * | 2/2006 | Ohanian | 211/41.11 |
| 7,131,545 | B1 | | 11/2006 | Grogan | |
| 7,469,792 | B1 | * | 12/2008 | Lin | 211/74 |
| 2002/0036178 | A1 | * | 3/2002 | Tombu | 211/74 |
| 2002/0121456 | A1 | | 9/2002 | Mannion et al. | |
| 2003/0015487 | A1 | * | 1/2003 | Henderson et al. | 211/74 |
| 2005/0269277 | A1 | * | 12/2005 | Su | 211/74 |

FOREIGN PATENT DOCUMENTS

| | | |
|---|---|---|
| JP | 09-299258 | 11/1997 |
| JP | 2003-024263 | 1/2003 |
| JP | 2005-185562 | 7/2005 |

* cited by examiner

*Primary Examiner*—Jennifer E. Novosad
(74) *Attorney, Agent, or Firm*—John J. Welch, Jr., Esq.

(57) ABSTRACT

A multifunctional cup holding rack with a plurality of interconnected open cupholding compartments featuring backside magnetic elements for holding the rack fast against a vertically inclined metallic surface and characterized further by the presence of topside hookloop components and bottomside hook components for holding one rack below and connected to another.

3 Claims, 13 Drawing Sheets

MULTIFUNCTIONAL CUP HOLDING RACK

CROSS REFERENCES TO PRIOR OR PARENT APPLICATIONS

There are no prior or parent applications to which the instant invention relates.

FEDERALLY SPONSORED RESEARCH AND DEVELOPMENT

The instant invention has not been, nor, is it the subject of any federally sponsored research and/or development.

BACKGROUND OF THE INVENTION

1. Field of the Invention

The instant invention is one of those sorts of devices serving to hold in place a plurality of cups primarily containing sold material.

2. Related Art

The herewith submitted Information Disclosure Statement reflects art that however, respectfully submitted, does not anticipate the instant invention.

SUMMARY OF THE INVENTION

1. A Brief Description of the Invention

The instant invention is a cupholding rack device. The device is typically metallic but could be made of hard, durable plastic material as well. It consists of a plurality of open cupholding compartments connected by one of the same to one or two others in each of a plurality, typically, a pair of rows within the rack. For example, the most lateral compartments in each row are each connected to one other. Inner positioned compartments would be each connected to two others. Each compartment consists of a compartment loop contiguous with one or two other such loops depending up on whether it's a laterally or inner positioned one. The invention is moreover characterized by the presence of a pair of backside magnets held within magnet holding rings or a backside magnetic bar that serve to permit a holding of the rack against a vertically inclined metallic surface such as the frontside of a refrigerator instead of being left alternatively to merely rest atop a shelf or table. Also, a pair of coupled topside hookloop components, one such loop, an upper loop unit being contiguous with and located just above and one other such loop, a lower loop unit, being contiguous with and located just below each one of the abovementioned magnet holding rings, together with a pair of bottomside hook components, enable one rack to hold just beneath it yet another complete rack with each of the racks either then both being magnetically held together against the vertically inclined metallic surface or, otherwise being simply suspended together from hooks screwed into the bottomside of an elevated cupboard and affixed into each one of a corresponding couple of the abovementioned upper or lower loop units.

2. Objects of the Invention

It is becoming increasingly in vogue for people to purchase multiple cup-paks containing ground-up coffee or tea under seal for use instantly in the home. The instant invention provides a ready and likewise decorous means for conveniently storing a relative plethora of such cup-paks for use by such persons. Moreover, the invention further provides a means for localizing multiple cuplike open containers each holding various and sundry small knick-knack and craft items such as, for example, spools of thread, small packets of sewing needles, spare buttons, paperclips and other items of a similar nature. In short, the invention is meant to, and indeed does serve to provide a homemaker with a convenient, localized and, at the same time, aesthetically pleasing means for storing not only a goodly number of such cup-paks but also a relatively large number of small, but essential craft items oftentimes otherwise mislain by virtue of being invariably placed here and there throughout a person's house.

A DESCRIPTION OF THE DRAWINGS

A DESCRIPTION OF THE PREFERRED EMBODIMENT

Figure 1:
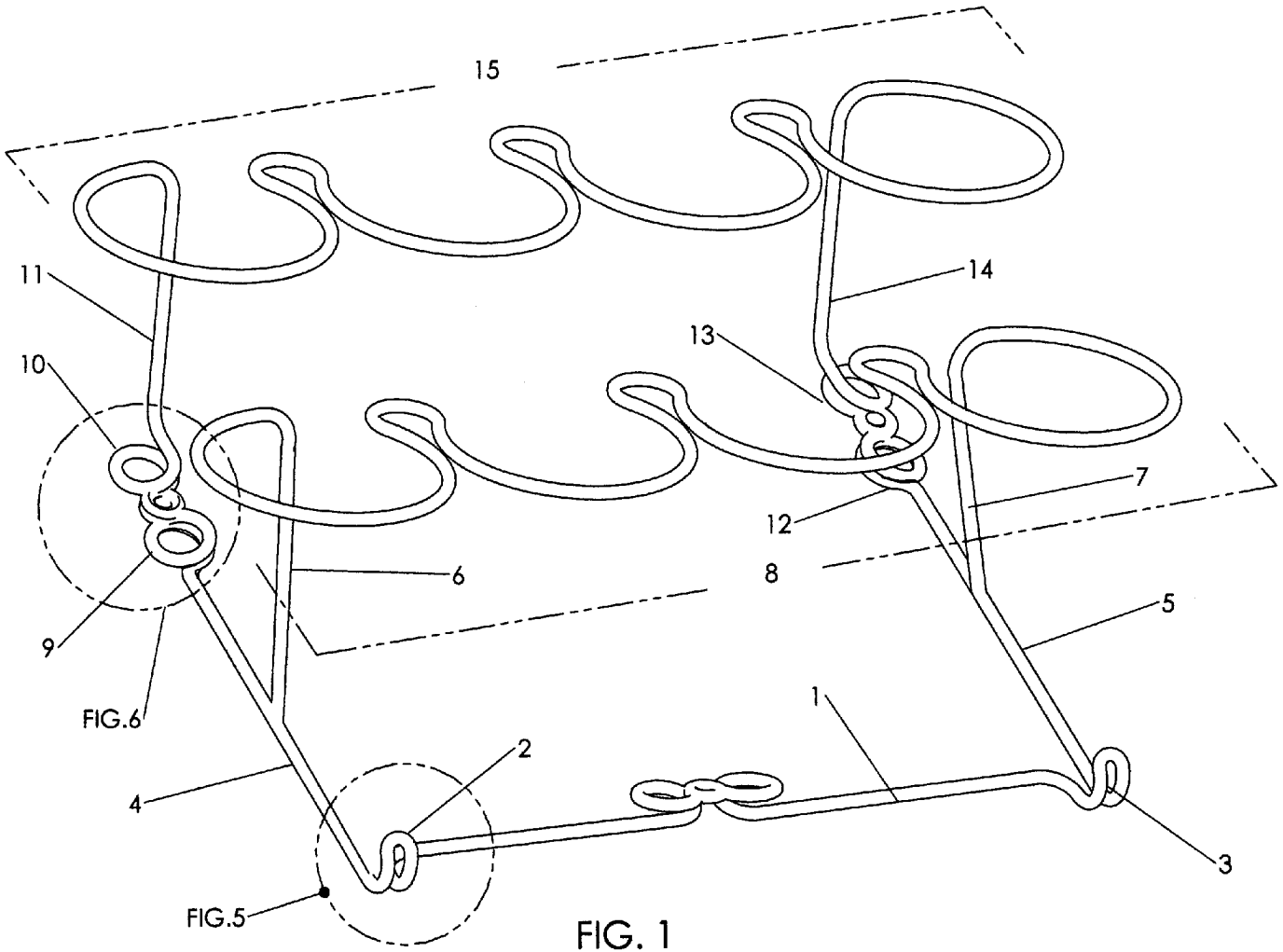
FIG. 1 is a frontally inclined perspective view of the invention.
Figure 2:
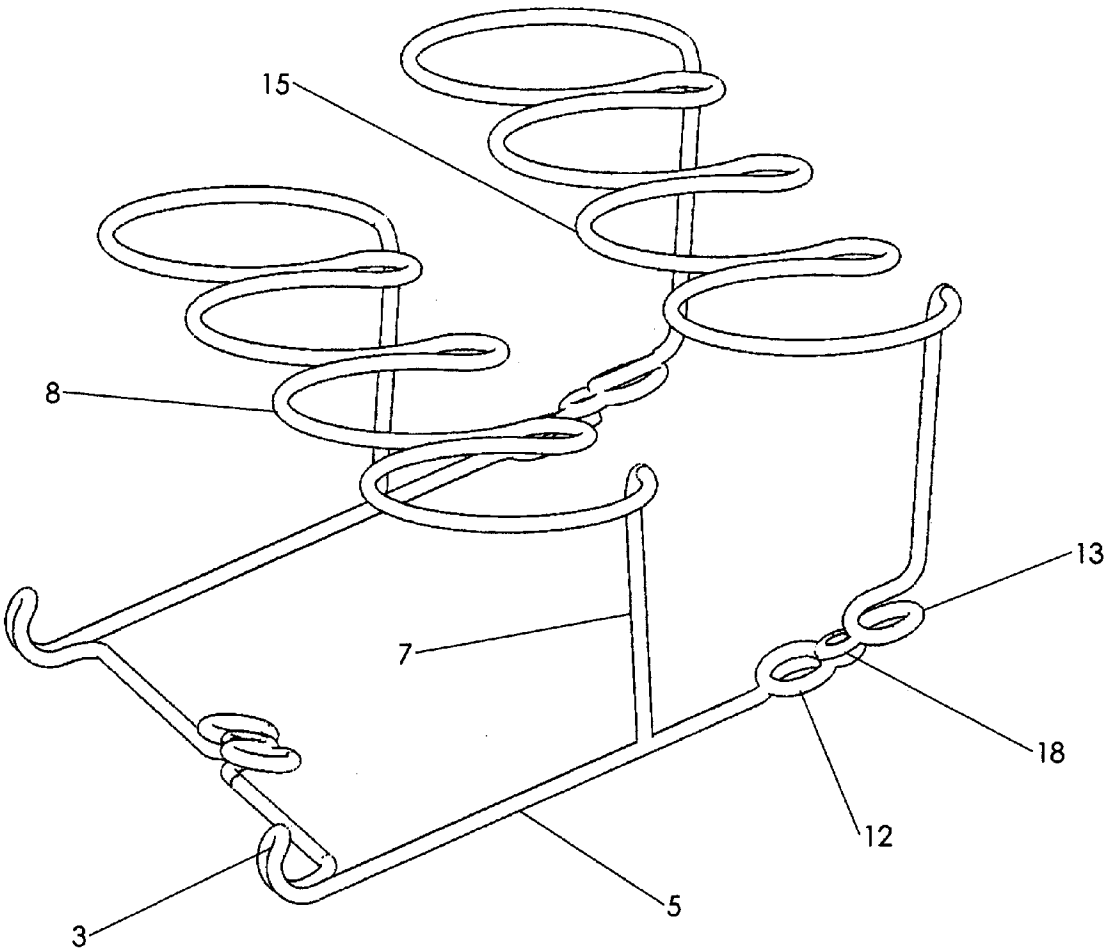
FIG. 2 is a laterally inclined plan view of the invention.
Figure 3:
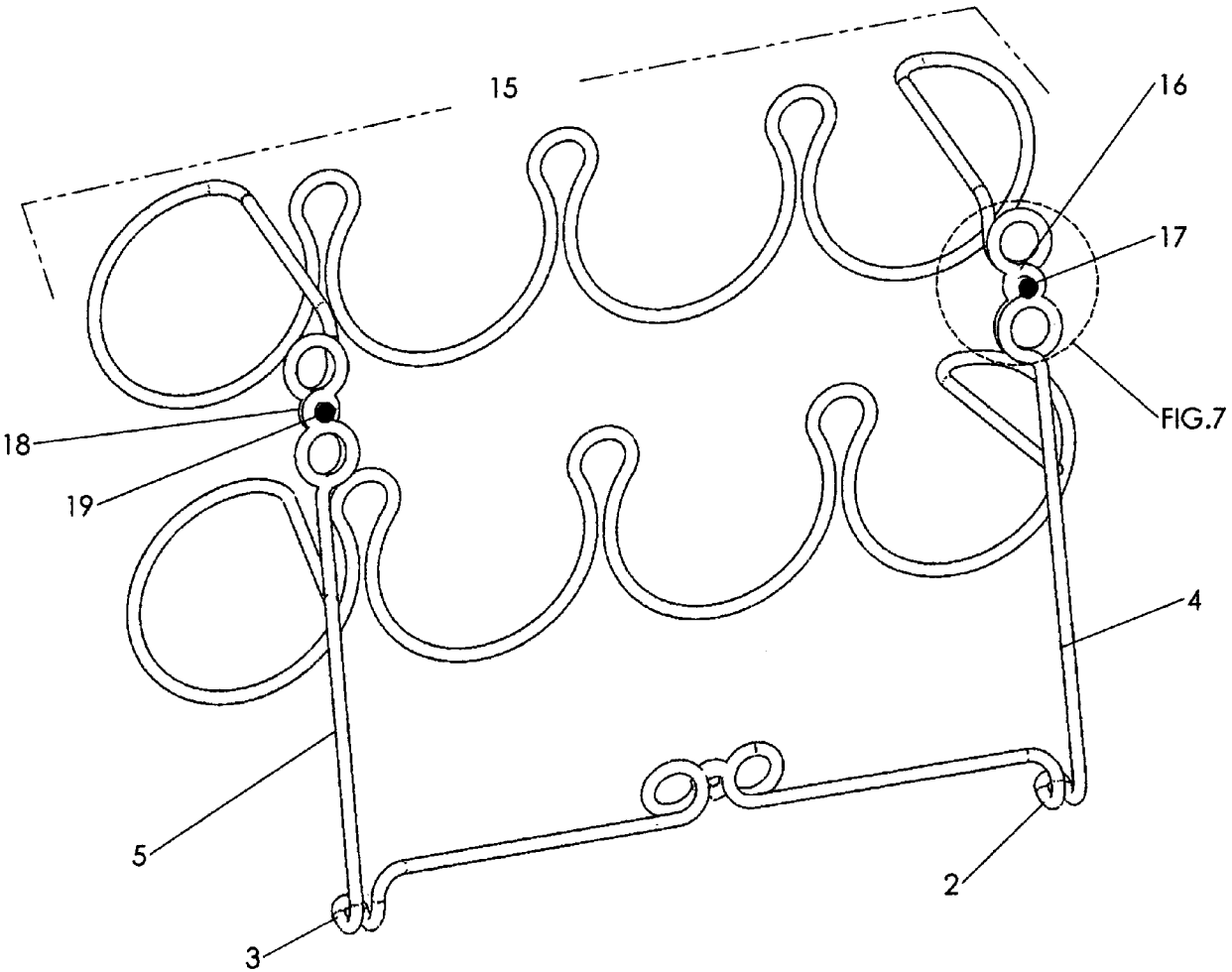
FIG. 3 is a posteriorly inclined perspective view of the invention.
Figure 4:
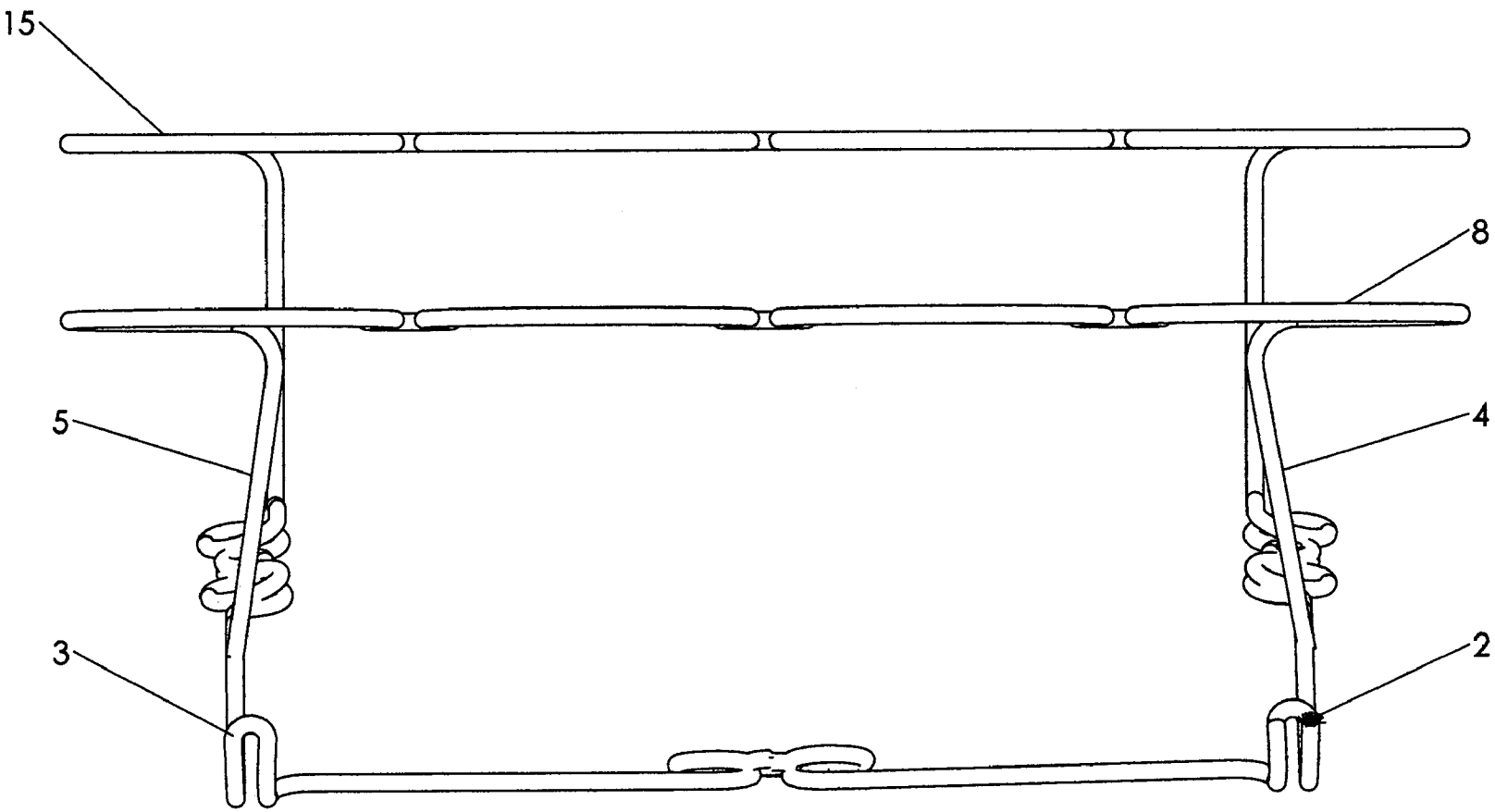
FIG. 4 is a bottomwise perspective view of the invention.
Figure 5:
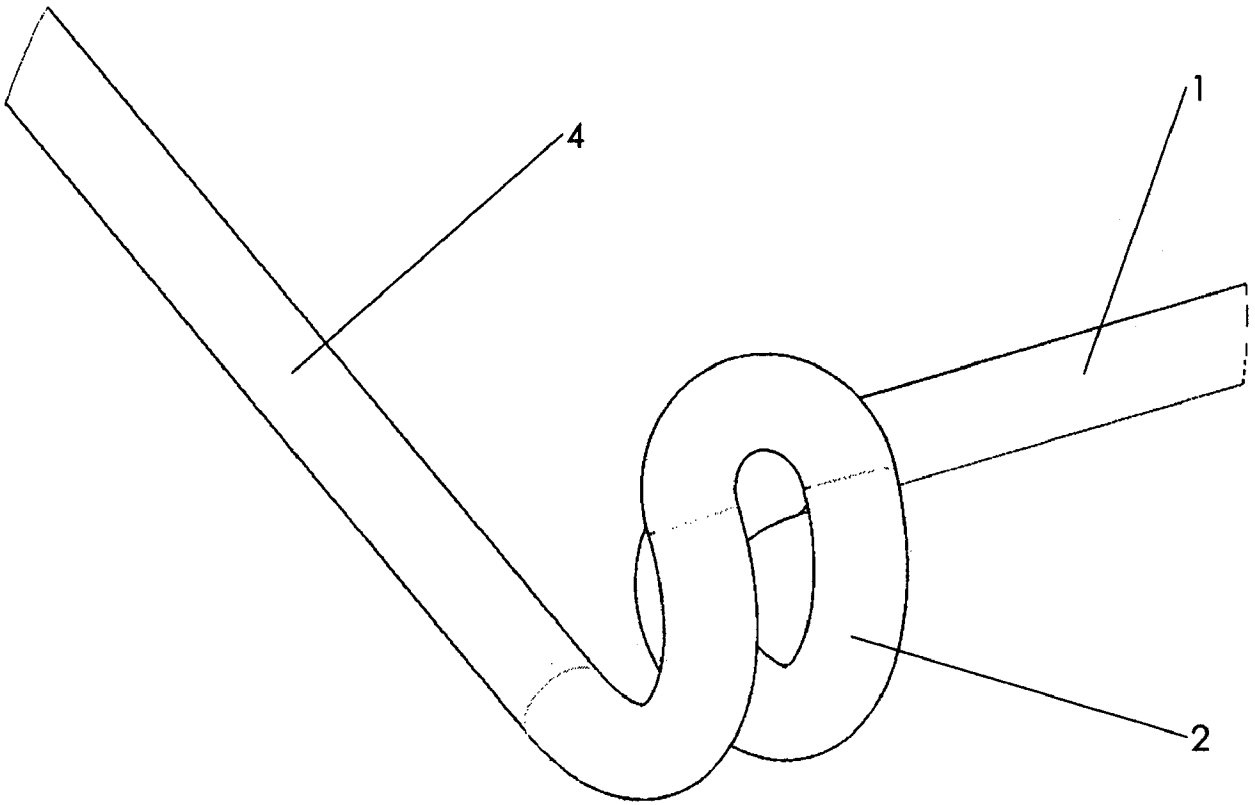
FIG. 5 is an isolated view of one of the two topside hook components of the invention.
Figure 6:
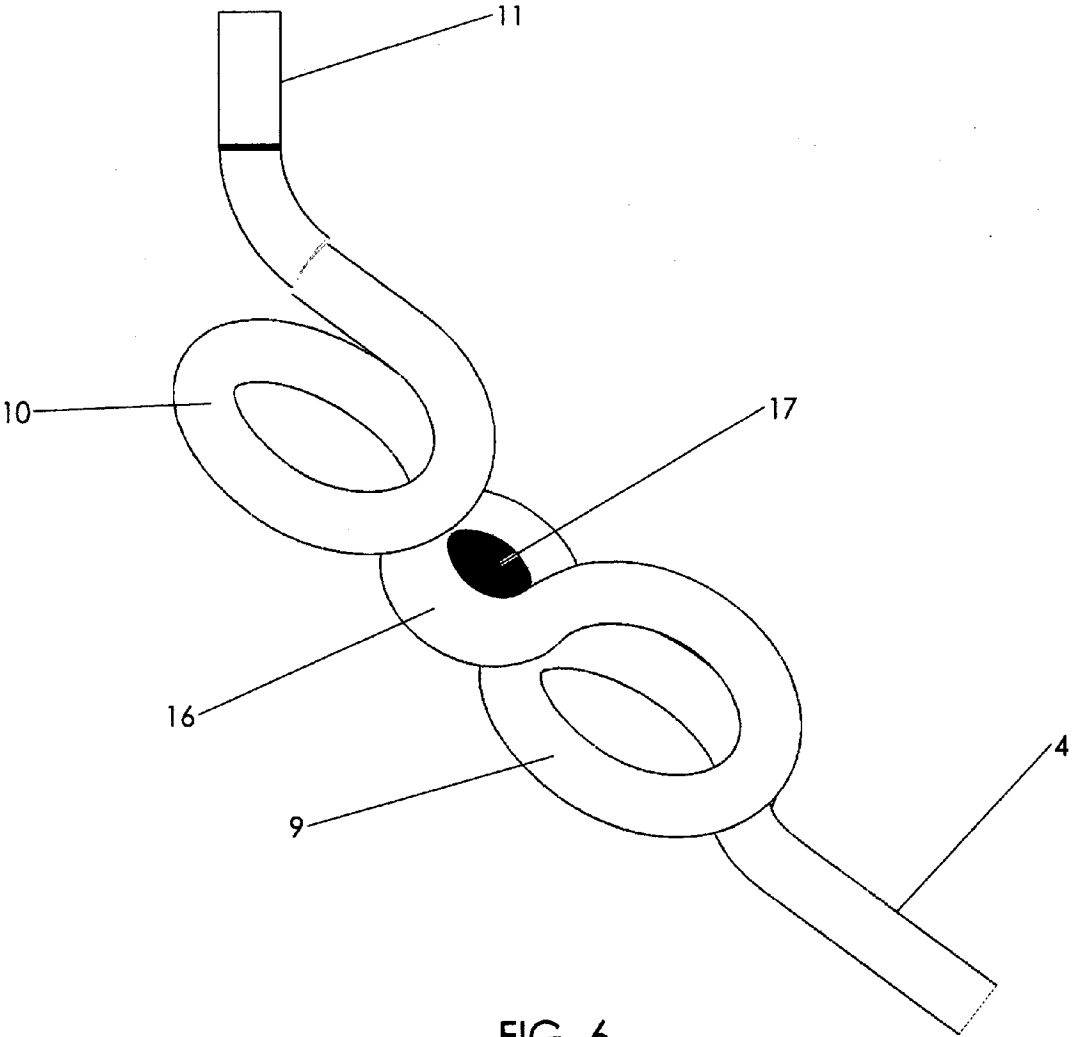
FIG. 6 is an isolated view of one of the two topside hookloop component systems of the invention.
Figure 7:
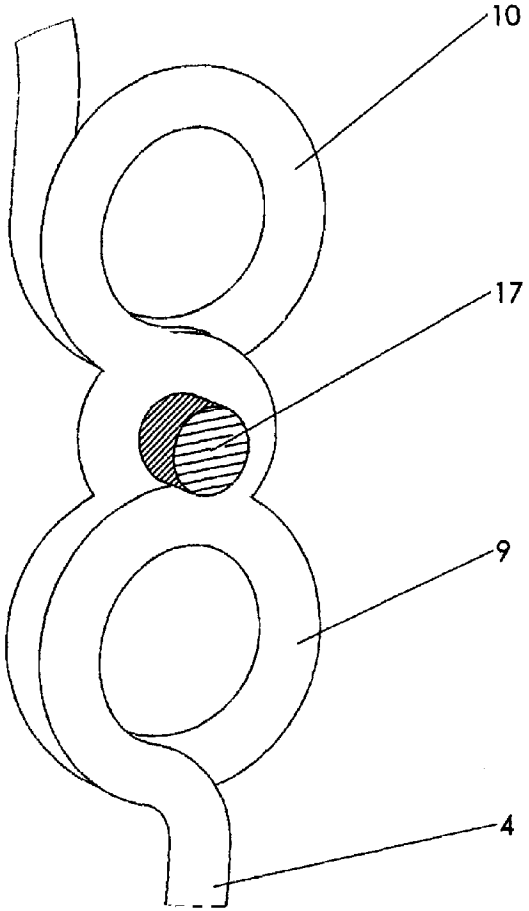
FIG. 7 is an isolated view of one of the two backside magnets being parts of the invention.

FIG. 1, a frontally inclined perspective view of the invention depicts the essential features of the invention. Frontal cross rod 1 is seen whereupon at the first end thereof and about the frontal end of first lateral support rod 4, there is formed and to be found first bottomside outwardly and upwardly extending hook component 2. At the other end of frontal cross rod 1, there is to be found about the frontal end of second lateral support rod 5, second bottomside outwardly and upwardly extending hook component 3. As can be noted from a viewing of FIG. 1, bilinear base portions and in turn, the remnant portions of hook components 2 and 3 are formed from the end portions of rod 1 and rod 4 as well as again rod 1 and rod 5 respectively. This feature of the invention serves to provide notable holding strength as respects hook components 2 and 3. In FIG. 1 there is also be seen first posteriorly inclined upright rod 6 as well as second posteriorly inclined upright rod 7. First row 8 of rounded, partially open cupholding compartments conjoined one to another, with the first outermost one of the compartments being coterminus with the upper portion of rod 6 and the second outermost one being coterminus with the upper portion of rod 7, is also seen in FIG. 1. First hookloop component 9 being a lower loop unit is coterminus with the upper portion of rod 4 as seen in FIG. 1 and more particularly in FIG. 3. There is also to be seen in FIGS. 1, 3 and especially FIG. 6, first magnet holding ring 16 coterminus with hookloop component 9 and likewise coterminus with second hookloop component 10 an upper loop unit located just above ring 16. Third posteriorly inclined rod 11 is coterminus with hookloop component 10 as seen in FIG. 1. Third hookloop component 12, being another lower loop unit, is coterminus with the upper portion of rod 5 as can be noted with reference to FIGS. 1, 2 and 3. Also, there is to be seen in FIGS. 1 and 3, second magnet holding ring 18 coterminus with hookloop component 13, another upper loop unit, located just above ring 18. Fourth posteriorly inclined rod 14 is moreover coterminus with hookloop component 13 as also seen in FIG. 1. Second row 15 of rounded, partially open cupholding compartments conjoined to one another, with the first outermost one of the compartments being coterminus with the upper portion of rod 11 and the second outermost one being coterminus with the upper portion of rod 14, is also seen in FIG. 1. FIGS. 3 and 7 depicted the holding of magnet 17 within ring 16. Magnet 19 is similarly held within ring 18. FIG. 4 shows the invention viewed from the bottom thereof. FIG. 5 is a close up view of hook component 2 being structurally equivalent to hook component 3. FIG. 6 serves to, in particular, depict the positional relationship of hookloop components 9 and 10. The positional relationship between hookloop components 12 and 13 is equivalent to the one as between hookloop components 9 and 10.

Figure 8:
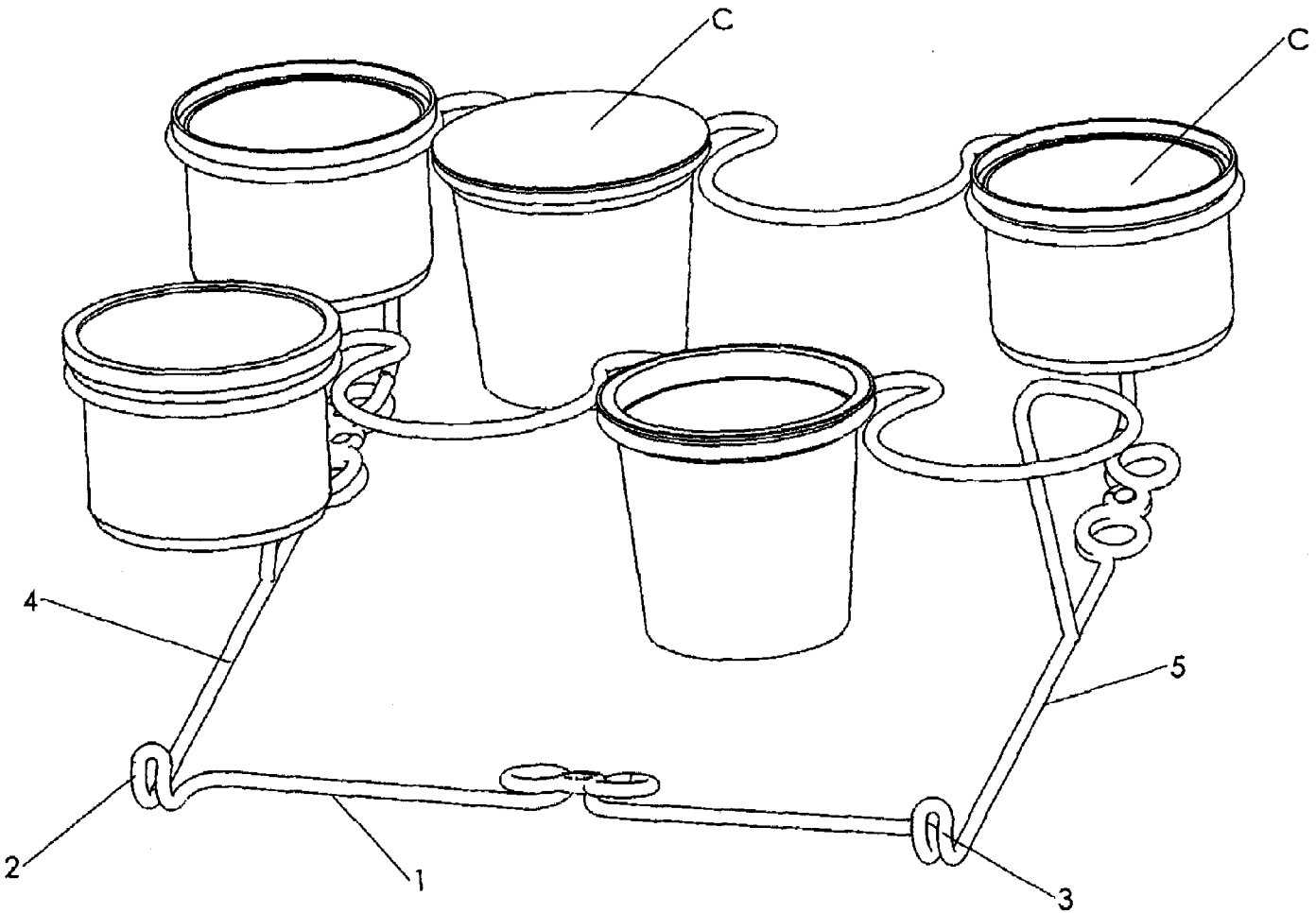
FIG. 8 illustrates the manner in which a plurality of cups are held by the invention.
Figure 9:
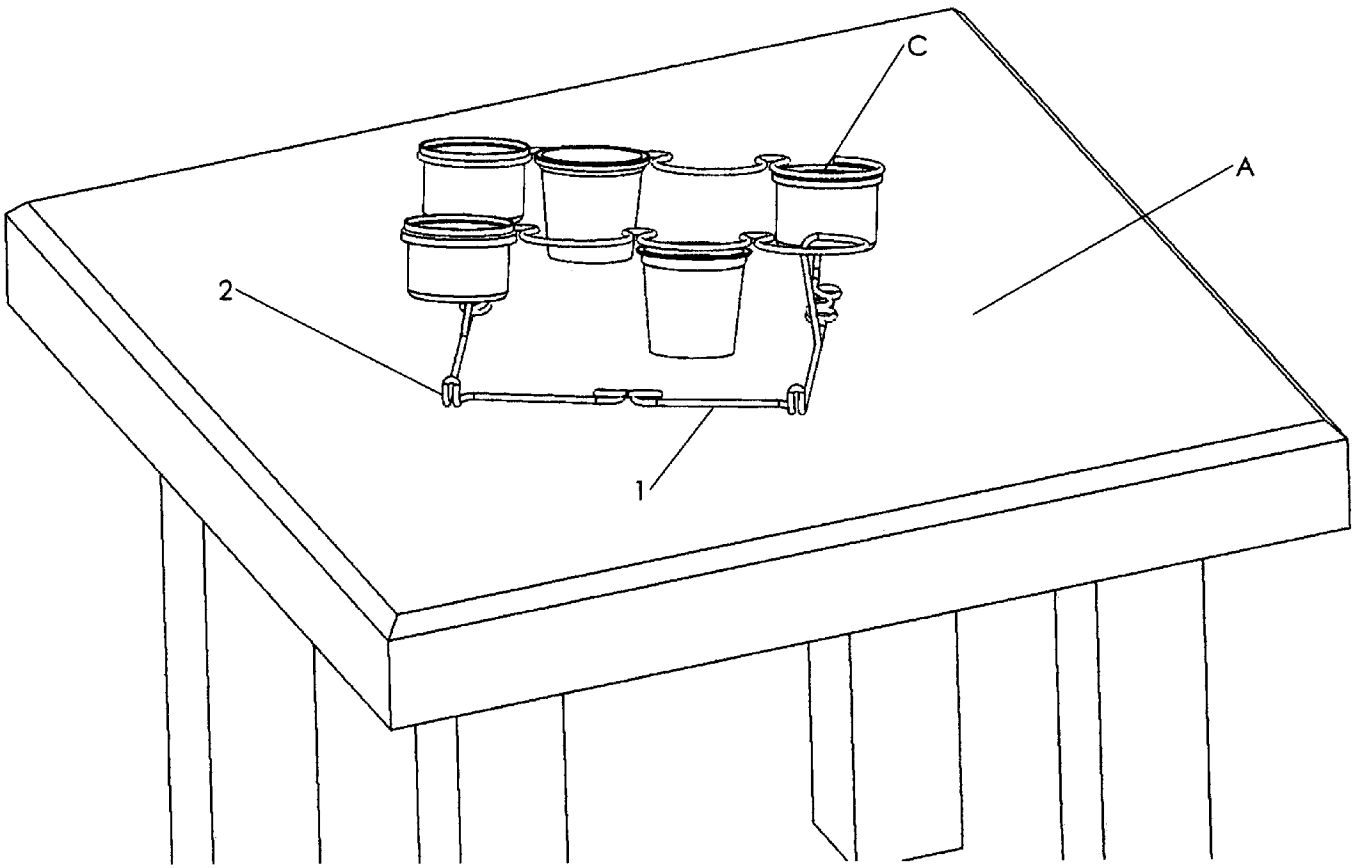
FIG. 9 illustrates the manner in which the invention placed upon a tabletop holds such cups.
Figure 10:
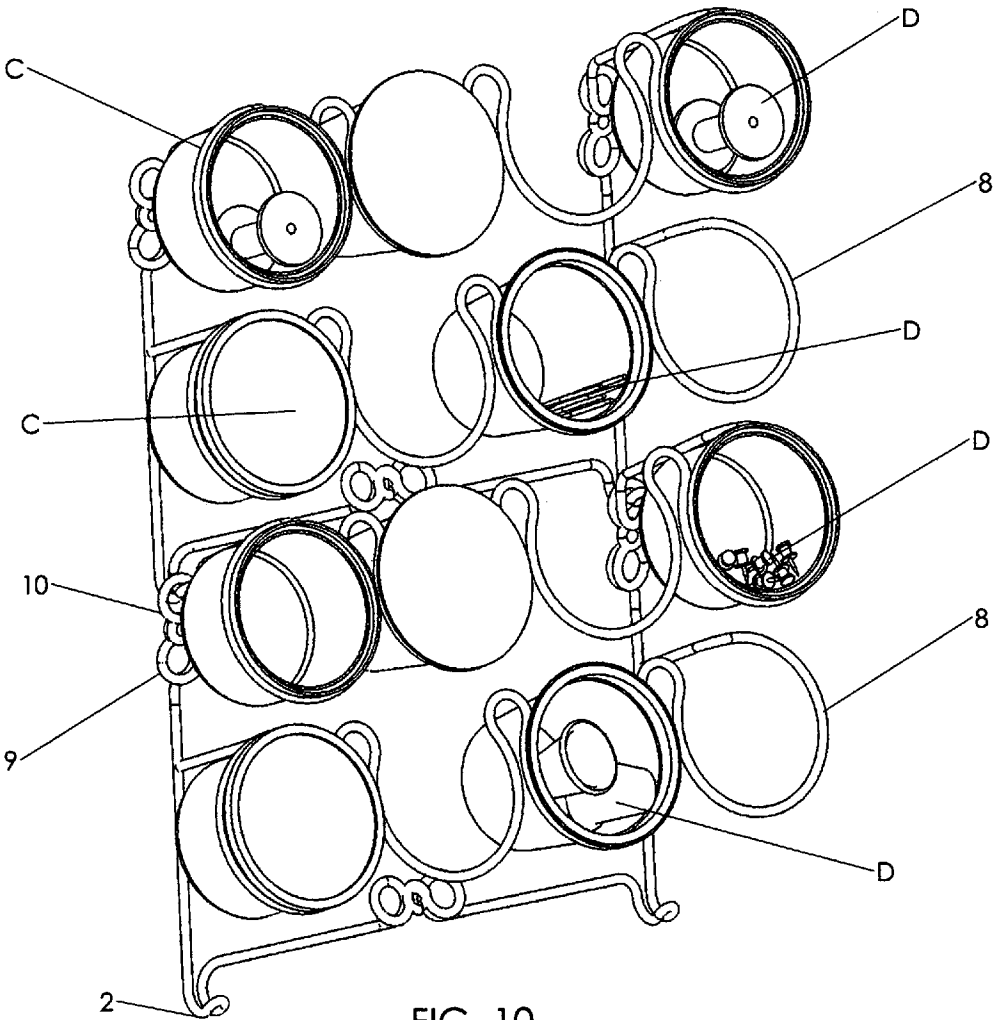
FIG. 10 illustrates in isolated view how one invented rack holding cups in turn supports yet another rack also holding cups.

The invention, as described above, serves to hold a plurality of cup units C as seen in FIG. 8. Such cup units C can hold craft items such as pins, tacks, spools of thread, needles and the like or they can be cup units C that are already sealed and capped containing, for example pre-processed coffee grains. FIG. 9 shows the invention holding cup units C resting upon the top of a table A to be found either in someone's home or office. FIG. 10 illustrates in isolated view the manner in which one embodiment of the invention via insertion of the hook components 2 and 3 thereof into the corresponding hookloop components 9 and 12 or 10 and 13 of another embodiment thereof can hold the other suspended therefrom. In this manner, many cup units C containing, for instances, in the aggregate, many craft items D and/or numerous and varied types of flavored and unflavored variants of coffees and teas can be conveniently held and stored by someone in the home.

Figure 11:
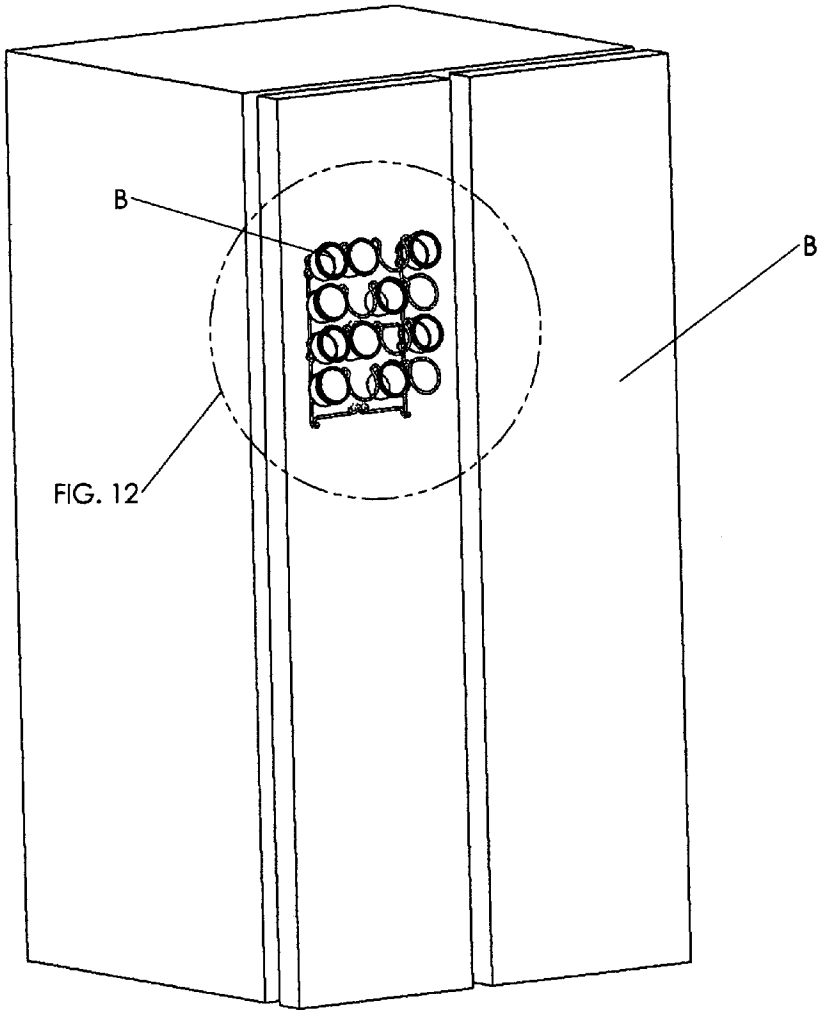
FIG. 11 illustrates one rack holding cups and likewise holding a second rack with cups with both racks in turn being held against a refrigerator door.
Figure 12:
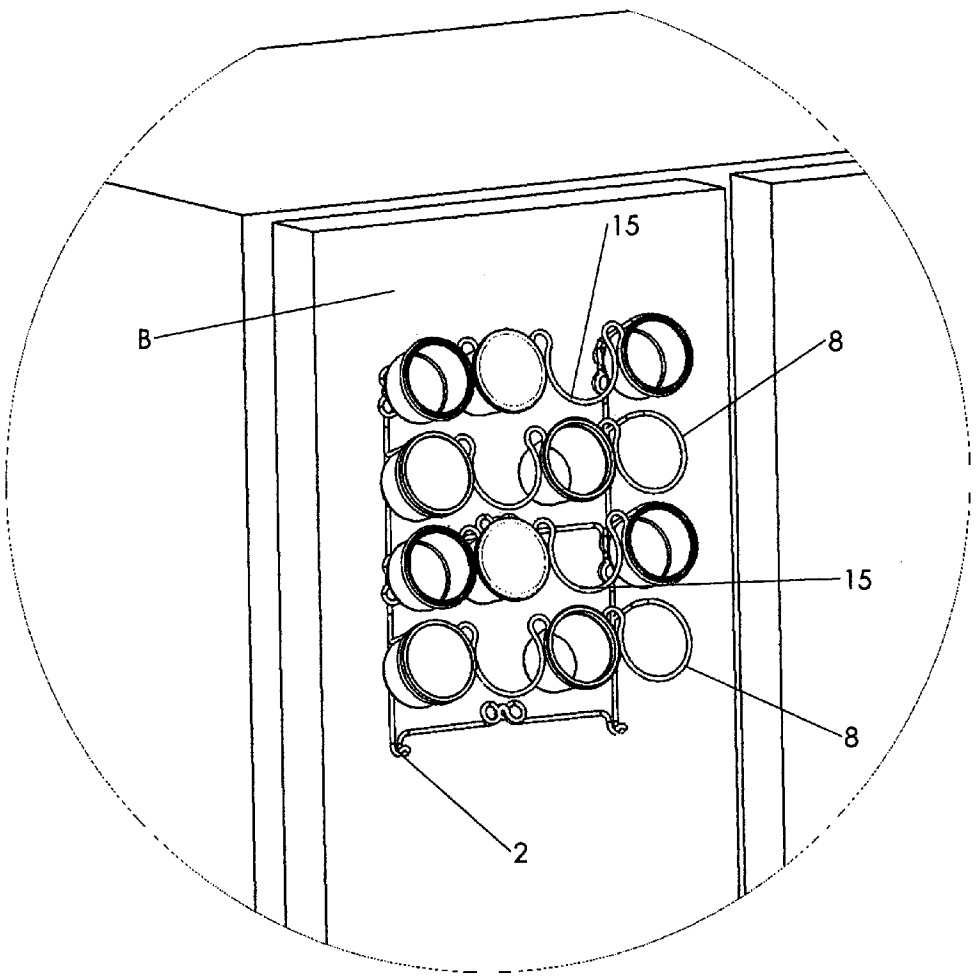
FIG. 12 illustrates in isolated view one rack holding cups and likewise holding a second rack with cups with both racks in turn being held against a refrigerator door.
Figure 13:
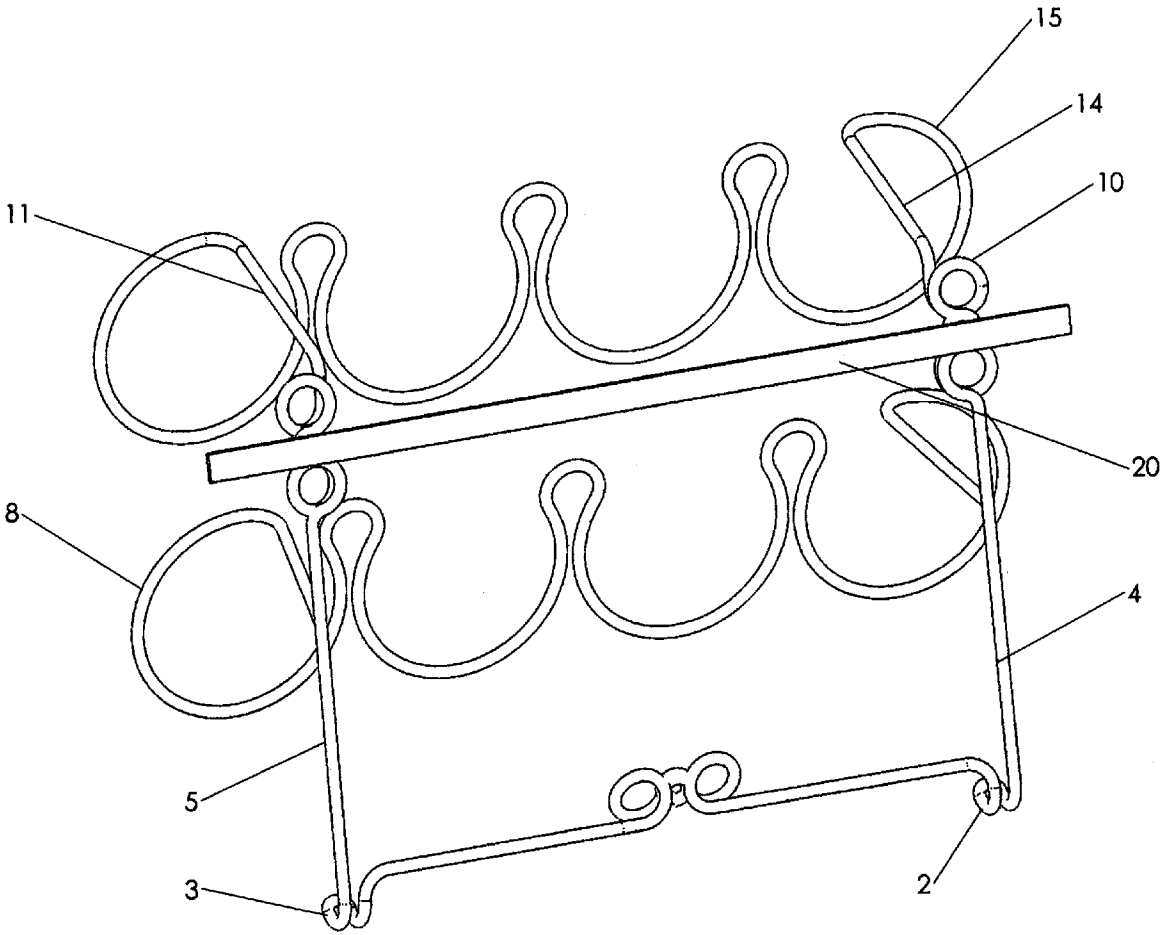
FIG. 13 is a posteriorly inclined perspective view of a second embodiment of the invention.

It will at once be able to be noted as to how such suspension of a plurality of embodiments of the invention so held together could; for example, via hooks screwed into a bottomside cupboard space located above eye level, be accomplished by way of simply inserting the hooks through corresponding hookloop components 9 and 12 of the uppermost one of the system of conjoined embodiments. FIG. 12 is a close-up view of FIG. 11 showing the invention being held fast to a refrigerator door B via magnets 17 and 19. Alternatively, screws through corresponding hookloop components 9 and 12 and screwed into a metallic wall could serve to in conjunction with magnets 17 and 19, more efficaciously hold an embodiment of, or system of conjoined embodiments of the invention against such walling within a home or workplace office. Moreover, screws through corresponding hook loop components 9 and 12 and screwed into a non-metallic wall could serve to hold an embodiment of, or system of conjoined embodiments of the invention against such walling within a home or workplace office. FIG. 13 depicts yet a second embodiment of the invention whereby magnets 17 and 19 are replaced with magnetic bar 20 affixed to and over the posterior outer surfaces of rings 16 and 18 respectively.

In conclusion, respectfully submitted, in view of the unquestionable versatility of the invention as noted above, the invention is not merely new, useful and unique but is indeed revolutionary in the art contemplating such devices.

What is claimed is:

1. A Multifunctional Cup Holding Rack, comprising:

a. a frontal crossbar;

b. a first bottomside outwardly and upwardly extending hook component;

c. a second bottomside outwardly and upwardly extending hook component;

d. a first lateral support bar;

e. a second lateral support bar;

f. a first end of said frontal crossbar and a frontal end of said first lateral support bar forming a bilinear base portion of said first hook component;

g. a second end of said frontal crossbar and a frontal end of said second lateral support bar forming a bilinear base portion of said second hook component;

h. a first posteriorly inclined upright bar affixed to said first lateral support bar;

i. a second posteriorly inclined upright bar affixed to said second lateral support bar;

j. a first row of rounded, partially open cupholding compartments conjoined one to another with a first outermost one of said compartments being coterminus with an upper portion of said first upright bar and with a second outermost one of said compartments being coterminus with an upper portion of said second upright bar;

k. a first hookloop component being coterminus with said first lateral support bar;

l. a first magnet holding ring being coterminus with and located above said first hookloop component;

m. a second hookloop component being coterminus with and located above said first magnet holding ring;

n. a third posteriorly inclined upright bar being coterminus with said second hookloop component;

o. a third hookloop component being coterminus with said second lateral support bar;

p. a second magnet holding ring being coterminus with and located above said third hookloop component;

q. a fourth hookloop component being coterminus with and located above said second magnet holding ring;

r. a fourth posteriorly inclined upright bar being coterminus with said fourth hookloop component;

s. a second row of rounded, partially open cupholding compartments conjoined one to another with a first outermost one of said second row of said compartments being coterminus with an upper portion of said third upright bar and with a second outermost one thereof being coterminus with an upper portion of said fourth upright bar;

t. a first magnet affixed to said first magnet holding ring, and;

u. a second magnet affixed to said second magnet holding ring.

2. A Multifunctional Cup Holding Rack, comprising:

a. a frontal crossrod;

b. a first bottomside outwardly and upwardly extending hook component;

c. a second bottomside outwardly and upwardly extending hook component;

d. a first lateral support rod;

e. a second lateral support rod;

f. a first end of said frontal crossrod and a frontal end of said first lateral support rod forming a bilinear base portion of said first hook component;

g. a second end of said frontal crossrod and a frontal end of said second lateral support rod forming a bilinear base portion of said second hook component;
h. a first posteriorly inclined upright rod affixed to said first lateral support rod;
i. a second posteriorly inclined upright rod affixed to said second lateral support road;
j. a first row of rounded, partially open cupholding compartments conjoined one to another with a first outermost one of said compartments being coterminus with an upper portion of said first upright rod and with a second outermost one of said compartments being coterminus with an upper portion of said second upright rod;
k. a first hookloop component being coterminus with said first lateral support rod;
l. a first magnet holding ring being coterminus with and located above said first hookloop component;
m. a second hookloop component being coterminus with and located above said first magnet holding ring;
n. a third posteriorly inclined upright rod being coterminus with said second hookloop component;
o. a third hookloop component being coterminus with said second lateral support rod;
p. a second magnet holding ring being coterminus with and located above said third hookloop component;
q. a fourth hookloop component being coterminus with and located above said second magnet holding ring;
r. a fourth posteriorly inclined upright rod being coterminus with said fourth hookloop component;
s. a second row of rounded, partially open cupholding compartments conjoined one to another with a first outermost one of said second row of said compartments being coterminus with an upper portion of said third upright rod and with a second outermost one thereof being coterminus with an upper portion of said fourth upright rod;
t. a first magnet affixed to said first magnet holding ring, and;
u. a second magnet affixed to said second magnet holding ring.

3. A Multifunctional Cup Holding Rack, comprising:
a. a frontal crossrod;
b. a first bottomside outwardly and upwardly extending hook component;
c. a second bottomside outwardly and upwardly extending hook component;
d. a first lateral support rod;
e. a second lateral support rod;
f. a first end of said frontal crossrod and a frontal end of said first lateral support bar forming a bilinear base portion of said first hook component;
g. a second end of said frontal crossrod and a frontal end of said second lateral support bar forming a bilinear base portion of said second hook component;
h. a first posteriorly inclined upright rod affixed to said first lateral support rod;
i. a second posteriorly inclined upright rod affixed to said second lateral support rod;
j. a first row of rounded, partially open cupholding compartments conjoined one to another with a first outermost one of said compartments being coterminus with an upper portion of said first upright rod and with a second outermost one of said compartments being coterminus with an upper portion of said second upright rod;
k. a first hookloop component being coterminus with said first lateral support rod;
l. a first magnet holding ring being coterminus with and located above said first magnet holding ring;
m. a second hookloop component being coterminus with and located above said first hookloop component;
n. a third posteriorly inclined upright rod being coterminus with said second hookloop component;
o. a third hookloop component being coterminus with said second lateral support rod;
p. a second magnet holding ring being coterminus with and located above said third hookloop component;
q. a fourth hookloop component being coterminus with and located above said second magnet holding ring;
r. a fourth posteriorly inclined upright rod being coterminus with said fourth hookloop component;
s. a second row of rounded, partially open cupholding compartments conjoined one to another with a first outermost one of said second row of said compartments being coterminus with an upper portion of said third upright rod and with a second outermost one thereof being coterminus with an upper portion of said fourth upright rod, and;
t. a magnetized bar affixed at a first end thereof to said first magnet holding ring and at a second end thereof to said second magnet holding ring.

* * * * *